US009375124B2

(12) United States Patent
Hall et al.

(10) Patent No.: US 9,375,124 B2
(45) Date of Patent: Jun. 28, 2016

(54) SCRUB DECK RETRACTION APPARATUS

(75) Inventors: Aaron T. Hall, Carey, OH (US); Kale R. Johnson, Minneapolis, MN (US)

(73) Assignee: Nilfisk, Inc., Plymouth, MN (US)

( * ) Notice: Subject to any disclaimer, the term of this patent is extended or adjusted under 35 U.S.C. 154(b) by 306 days.

(21) Appl. No.: 14/113,119

(22) PCT Filed: Apr. 20, 2012

(86) PCT No.: PCT/US2012/034546

§ 371 (c)(1),
(2), (4) Date: Dec. 30, 2013

(87) PCT Pub. No.: WO2012/145694

PCT Pub. Date: Oct. 26, 2012

(65) Prior Publication Data

US 2014/0102476 A1 Apr. 17, 2014

Related U.S. Application Data

(60) Provisional application No. 61/477,914, filed on Apr. 21, 2011.

(51) Int. Cl.

| | |
|---|---|
| ***B08B 7/00*** | (2006.01) |
| ***B08B 5/04*** | (2006.01) |
| ***A47L 11/32*** | (2006.01) |
| ***B60S 3/00*** | (2006.01) |
| ***A46B 5/00*** | (2006.01) |
| ***A46B 3/08*** | (2006.01) |
| ***A46B 13/00*** | (2006.01) |
| ***A47L 11/40*** | (2006.01) |
| ***A47L 11/24*** | (2006.01) |
| ***A47L 11/30*** | (2006.01) |
| ***A47L 11/283*** | (2006.01) |

(52) U.S. Cl.
CPC ..... *A47L 11/4058* (2013.01); *A47L 11/24* (2013.01); *A47L 11/283* (2013.01); *A47L 11/305* (2013.01); *A47L 11/4061* (2013.01)

(58) Field of Classification Search
None
See application file for complete search history.

(56) References Cited

U.S. PATENT DOCUMENTS 5,016,310 A * 5/1991 Geyer ..... A47L 11/293 15/49.1

FOREIGN PATENT DOCUMENTS

| | | | |
|---|---|---|---|
| DE | 9115578 | U1 | 2/1992 |
| EP | 0945551 | A1 | 9/1999 |
| WO | WO-2012145694 | A1 | 10/2012 |

OTHER PUBLICATIONS

EP0945551 English translation, accessed on Oct. 2015.*

(Continued)

*Primary Examiner* — Eric Golightly
*Assistant Examiner* — Arlyn I Rivera-Cordero
(74) *Attorney, Agent, or Firm* — Schwegman Lundberg & Woessner, P.A.

(57) ABSTRACT

A scrub deck assembly (59) comprises a scrub deck frame (76) and a pivot arm (70) having a first end (72) and a second end (74). The pivot arm is rotatably coupled to the scrub deck frame at the first end, and a scrub brush (56A) is operably coupled to the pivot arm at the second end. The scrub deck assembly further comprises a retraction mechanism (80) configured to allow movement of the pivot arm, relative to the scrub deck frame, about the first end. A release mechanism (92) is operably coupled to the retraction mechanism, and is configured to disengage the operation of the retraction mechanism.

19 Claims, 12 Drawing Sheets

(56) References Cited

OTHER PUBLICATIONS

"European Application Serial No. 12721050.8, Office Action mailed Jan. 1, 2014".
"European Application Serial No. 12721050.8, Response filed Jul. 17, 2014 to Office Action mailed Jan. 7, 2014", 26 pgs.
"International Application Serial No. PCT/US2012/034546, International Preliminary Report on Patentability mailed Oct. 31, 2013", 8 pgs.
"International Application Serial No. PCT/US2012/034546, International Search Report mailed Aug. 6, 2012", 5 pgs.
"International Application Serial No. PCT/US2012/034546, Written Opinion mailed Aug. 6, 2012", 7 pgs.

* cited by examiner

SCRUB DECK RETRACTION APPARATUS

CLAIM OF PRIORITY

This application is a U.S. National Stage Application filed under 35 U.S.C. §371 of International Application Serial No. PCT/US2012/034546, filed Apr. 21, 2012, and published on Oct. 26, 2012 as WO 2012/145694, which claims the benefit of priority of U.S. Provisional Application No. 61/477,914, filed Apr. 21, 2011, entitled "SCRUB DECK RETRACTION MECHANISM," all of which applications and publication are herein incorporated by reference in their entireties.

BACKGROUND

The present patent application relates generally to a cleaning apparatus. More specifically, the present patent application relates to a retraction apparatus for a scrub deck that allows one or more of a plurality of scrub brushes to rotate rearward and/or inward relative to the scrub deck.

Industrial and commercial floors are cleaned on a regular basis for aesthetic and sanitary purposes. There are many types of industrial and commercial floors ranging from hard surfaces such as concrete, terrazzo, wood, and the like, which can be found in factories, schools, hospitals, and the like, to softer surfaces such as carpeted floors found in restaurants and offices. Different types of floor cleaning equipment such as scrubbers, sweepers, and extractors, have been developed to properly clean and maintain these different floor surfaces.

A typical scrubber is a walk-behind or drivable, serf-propelled, wet process machine that applies a liquid cleaning solution from an on-board cleaning solution tank onto the floor through nozzles. Rotating brushes forming part of the scrubber agitate the solution to loosen dirt and grime adhering to the floor. The dirt and grime become suspended in the solution, which is collected by a vacuum squeegee fixed to a rearward portion of the scrubber and deposited into an onboard recovery tank.

Scrubbers are very effective for cleaning hard surfaces. Unfortunately, debris on the floor can clog the vacuum squeegee, and thus, the floor should be swept prior to using the scrubber. Therefore, sweepers are commonly used to sweep a floor prior to using a scrubber. A typical sweeper is a self-propelled, walk-behind or drivable dry process machine that picks debris off a hard or soft floor surface without the use of liquids. The typical sweeper has rotating brushes which sweep debris into a hopper or "catch bin."

Combination sweeper-scrubbers have also been developed that provide the sweeping and scrubbing functionalities in a single unit.

OVERVIEW

This overview is intended to provide an overview of subject matter of the present patent application. It is not intended to provide an exclusive or exhaustive explanation of the invention. The detailed description is included to provide further information about the present patent application.

In an example, a scrub deck assembly can be provided that includes a scrub deck frame and a pivot arm having a first end and a second end. The pivot arm can be rotatably coupled to the scrub deck frame at the first end, and a scrub brush can be operably coupled to the pivot arm at the second end. The scrub deck assembly can further include a retraction mechanism configured to allow movement of the pivot arm, relative to the scrub deck frame, about the first end. A release mechanism can be operably coupled to the retraction mechanism, and can be configured to disengage operation of the retraction mechanism.

In an example, a scrub deck assembly can be provided that includes a scrub deck fame, a first rotatable brush operably coupled to the scrub deck frame, and a pivot arm having a first end coupled to the scrub deck frame and a second end coupled to a second rotatable brush. The scrub deck assembly can also include a scrub deck retraction apparatus including a gas spring having a first end rotatably coupled to the scrub deck frame and a release mechanism coupled to both the pivot arm and to a second end of the gas spring. The gas spring can allow rotation of the pivot arm relative to the scrub deck frame, from an extended position to a retracted position, upon application of a force to the gas spring. When the release mechanism is moved to a released position, the force applied by the gas spring to urge the pivot arm to the extended position can be removed, thereby allowing the pivot arm to rotate freely inward and/or rearward upon application of a force to the pivot arm, the second rotatable brush, or an attached side skirt member.

In an example, a method of operating a scrub deck retraction apparatus can include providing or obtaining a scrub deck assembly having a first rotatable brush operably coupled to a scrub deck frame, a second rotatable brush operably coupled to a pivot arm, wherein the pivot arm is rotatably coupled to the scrub deck frame at a pivot point, and a scrub deck retraction apparatus including a gas spring extending between the scrub deck frame and the pivot arm and a release mechanism coupled to the gas spring. The gas spring can include a gas containing housing, and a gas spring rod. The method can also include rotating the release mechanism from an engaged position to a released position, thereby extending the gas spring rod from the gas containing housing, and retracting the second rotatable brush relative to the first rotatable brush by rotating the pivot arm about the pivot point.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Generally speaking, the present patent application relates to a retraction apparatus for a scrub deck that can allow one or more scrub brushes to rotate rearward and/or inward relative to the scrub deck. Particularly, the scrub deck retraction apparatus can include a gas spring that allows the one or more scrub brushes to retract upon application of force, such as with a wall or other fixed object, in order to prevent damage to the scrub deck. The scrub deck retraction apparatus can also include a manual retraction mechanism that can allow for rotation of the one or more scrub brushes to provide easier access to one or more "inner" scrub brushes. The scrub brush retraction apparatus in accordance with the present patent application can be configured for use on many types of cleaning machines that incorporate the use of scrub brushes, for purposes of example and not limitation, the scrub brush retraction apparatus of the present patent application will be described as applied to a combination sweeper-scrubber system.

Figure 1:
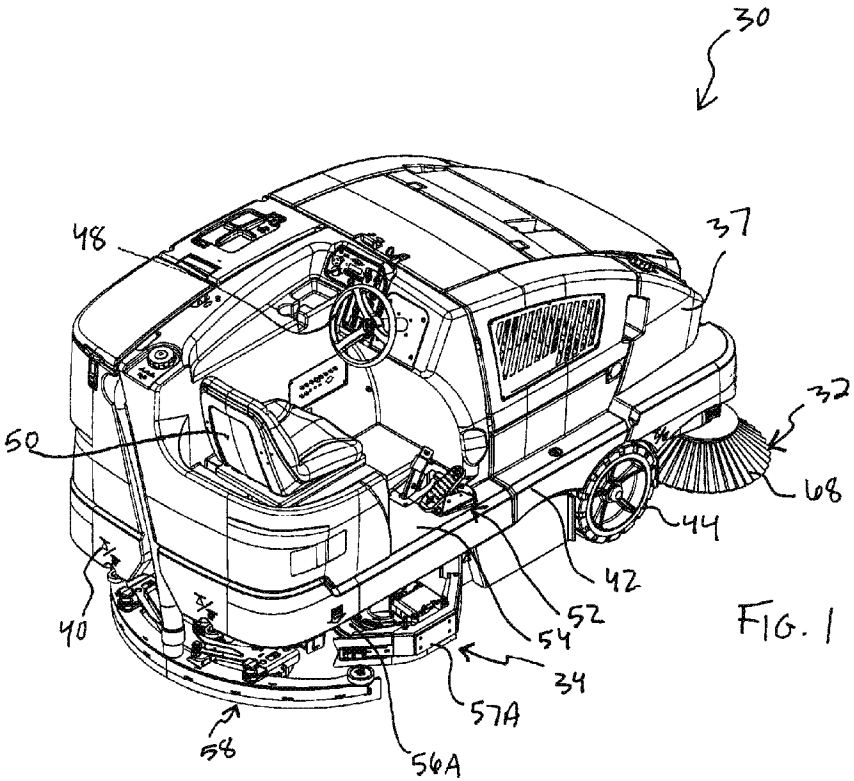
FIG. 1 is a top perspective view of a sweeper-scrubber that can utilize a scrub deck retraction apparatus in accordance with the present patent application.
Figure 2:
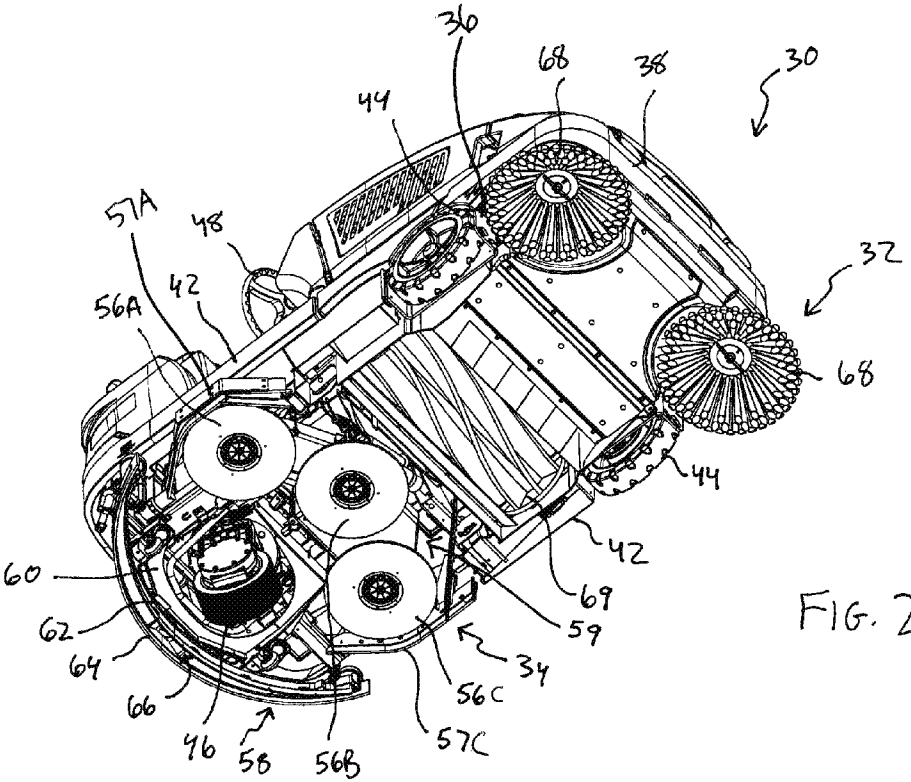
FIG. 2 is a bottom perspective view of the sweeper-scrubber of FIG. 1.

FIGS. 1 and 2 are top and bottom perspective views, respectively, of an example of a sweeper-scrubber 30 that can utilize a scrub brush retraction apparatus in accordance with the present patent application. As illustrated in FIGS. 1 and 2, the sweeper-scrubber 30 can include a sweeper system 32 for sweeping a floor surface and a scrubber system 34 for scrubbing the floor surface. Thus, as will be discussed in further detail below, the sweeper-scrubber 30 can be operable to sweep dirt and debris from the floor surface, apply a liquid cleaning solution from an onboard cleaning solution tank onto the floor being cleaned, and agitate the cleaning solution. Suction means can then be used to draw the cleaning solution into an onboard recovery tank.

Providing a floor cleaning system having both a sweeper system 32 and a scrubber system 34 can allow the operator to perform both "dry" and "wet" cleaning with the same system. These sweeping and scrubbing modes can be operated either separately or simultaneously depending upon the type of cleaning required.

As further illustrated in FIGS. 1 and 2, the sweeper-scrubber 30 can include a chassis 36 supporting a machine body 37 and having a forward end 38 and a rearward end 40 joined by sides 42. The chassis 36 can be supported by one or more floor engaging front wheels 44 and one or more rear steerable wheels 46. The one or more rear steerable wheels 46 can be operatively connected to a steering wheel 48 through the chassis 36. Alternatively, the chassis can be supported by one or more front steerable wheels and one or more floor engaging rear wheels.

A driver seat 50 can be supported by the machine body 37 rearward of the steering wheel 48 for use by an operator of the sweeper-scrubber 30. The operator can it on the driver seat 50 to operate the steering wheel 48 and foot operated control pedals 52, such as a brake and an accelerator, supported above a chassis top surface 54.

In operation, one or more nozzles can apply a liquid cleaning solution from an onboard cleaning solution tank onto the floor being cleaned. The cleaning solution can be gravity fed through the one or more nozzles, or alternatively pumped out of the cleaning solution tank through the one or more nozzles. The cleaning solution applied onto the floor can then be agitated by one or more ground engaging scrub brushes, such as scrub brushes 56A, 56B, and 56C. In an example, the scrub brushes 56A-56C together form a portion of a scrub deck assembly 59 of the scrubber system 34 adjacent to a bottom surface of the chassis 36. As illustrated in FIGS. 1 and 2, the outside scrub brush 56A and an associated skirt 57A can protrude from the side of the sweeper-scrubber 30 to improve scrubbing close to walls and other obstacles. As will be discussed in detail below, the outside scrub brush 56A can be attached to a pivoting arm that can allow the scrub brush 56A and the adjacent side skirt 57A to swing around a vertical axis, such that it can travel rearward and/or inward, to retract under the machine and prevent damage to the scrub deck assembly 59 caused by hitting obstacles.

As illustrated in FIGS. 1 and 2, the ground engaging scrub brushes 56A-56C can have substantially parallel axes of rotation that are generally perpendicular to the floor surface. The scrub brushes 56A-56C can be rotatably driven by a suitable motor, and can be configured to agitate the cleaning solution applied onto the floor surface to dislodge dirt and grime adhered thereto. In addition to the scrub brushes 56A-56C, the scrubber system 34 can further include a floor engaging vacuum squeegee assembly 58 positioned proximal the chassis rearward end 40. The agitated cleaning solution and suspended dirt and grime can be drawn off the floor surface through the squeegee assembly 58 and into the recovery tank for disposal.

The squeegee assembly 58 can be coupled to a squeegee support bracket 60 pivotally attached relative to the chassis 36, and can be moved between an operating position and a stored position (when not in use). The squeegee assembly 58, which can be operable to dry the floor being cleaned by the sweeper-scrubber 30, can include a forward arcuate squeegee blade 62 nested within a rearward arcuate squeegee blade 64. In an example, the nested squeegee blades 62 and 64 can extend substantially across the width of the sweeper-scrubber 30 and can define a crescent shaped vacuum zone 66. The squeegee blades 62 and 64 can be formed from any flexible material that can sealingly engage the floor, including elastomeric materials such as rubber, plastic, or the like.

The forward squeegee blade 62 can be configured to collect the cleaning solution on the floor, and can include notches in its floor engaging edge which allows the cleaning solution to enter the vacuum zone 66. The rearward squeegee blade 64 can include a continuous floor engaging edge in order to prevent the escape of the cleaning solution rearwardly from the vacuum zone 66.

As illustrated in FIGS. 1 and 2, a pair of side brooms 68 can be rotatably mounted proximal the chassis forward end 38 and forward of the ground engaging agitation brushes 56. The side brooms 68 can be driven by a suitable motor controlled by control circuitry. Each side broom 68 can be rotatable about a substantially vertical axis proximal one of the chassis sides 42, and can be configured to urge debris towards a centerline of the chassis 36 for pick-up by a main sweeper broom 69. In an example, the main sweeper broom 69 can be rotatable about a substantially horizontal axis. As illustrated in FIGS. 1 and 2, each side broom 68 can extend radially from its vertical axis past one side 42 of the chassis 36 in order to sweep the floor along a wall or other vertical or angled surface. Similar to the squeegee assembly 58, the side brooms 68 can be vertically movable between an operating position and a storage position.

Now that an example of a floor cleaning system has been described that can utilize the scrub deck retraction apparatus of the present patent application, the structure and operation of an exemplary scrub deck retraction apparatus 65 will be described in detail with reference to FIGS. 3-9B.

Figure 3:
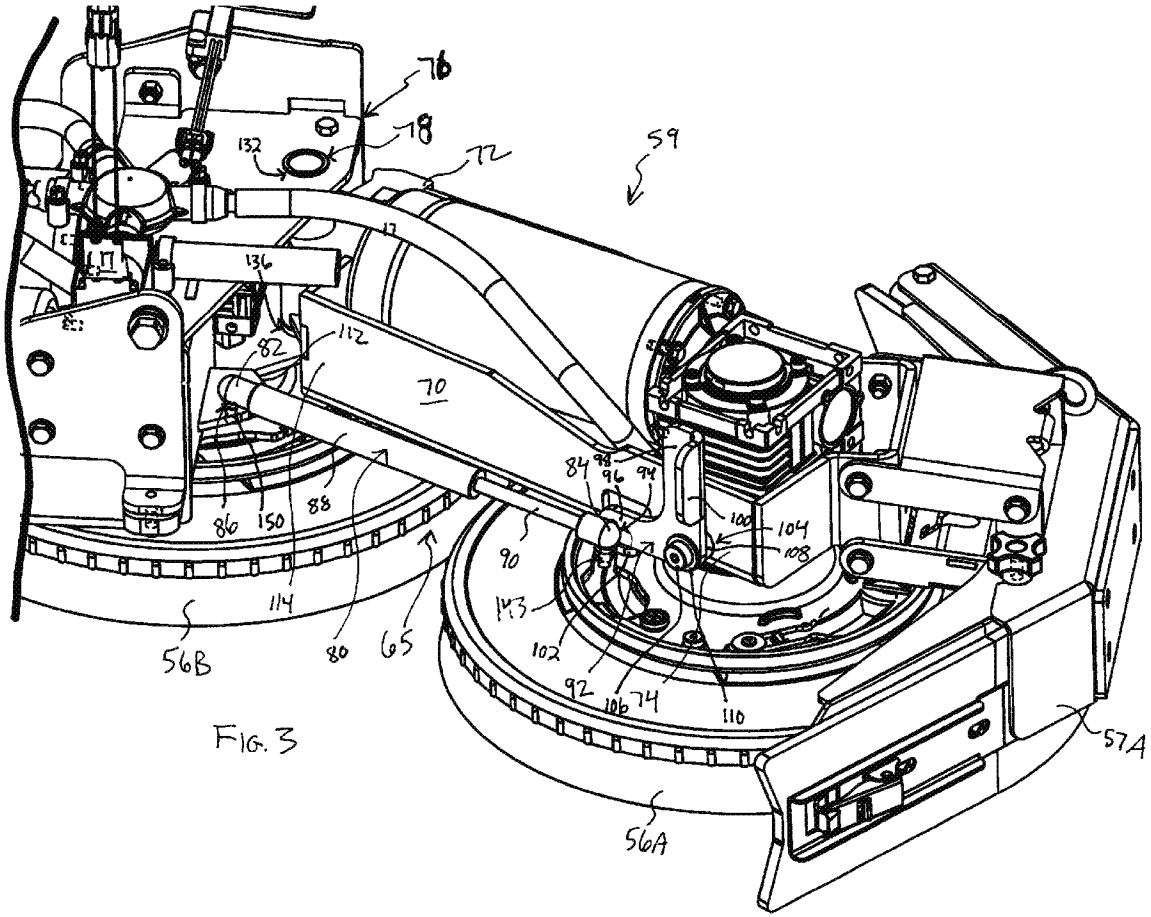
FIG. 3 is a partial perspective view of a scrub deck assembly removed from the sweeper-scrubber with a gas spring connection component disconnected from a rotating lever.

FIG. 3 is a partial perspective view of the scrub deck assembly 59 removed from the sweeper-scrubber 30. As illustrated in FIG. 3, the scrub deck assembly 59 can include a pivot arm 70 having a first end 72 and a second end 74. The first end 72 of the pivot arm 70 can be coupled to a scrub deck frame 76 of the scrub deck assembly 59 at a first pivot point 78. The outside scrub brush 56A can be operably coupled to the second end 74 of the pivot arm 70.

The scrub deck retraction apparatus 65 can include a scrub deck retraction mechanism 80 configured to allow controlled movement of the pivot arm 70 about the first pivot point 78 from an extended position to a retracted position. In an example, the scrub deck retraction mechanism 80 can comprise a gas spring (hereinafter referred to as gas spring 80). However, any suitable device that can provide a source of tension and resist rotation of the pivot arm 70 can be used including, but not limited to, struts, shocks, hydraulics, compression springs disposed within cylinders, or the like. Thus, gas springs are described herein merely for purposes of example and not limitation.

The gas spring 80 can be configured to provide a resistive force to keep the outside scrub brush 56A and the skirt 57A extended in normal use, but to compress and allow the brush 56A and the skirt 57A to retract when contacted with sufficient force to overcome the resistive force provided by the gas spring 80. The gas spring 80 can include a first end 82 and a second end 84, the first end 82 being rotatably coupled to the scrub deck frame 76 at a second pivot point 86.

The gas spring 80 can include a gas containing housing 88 and a gas spring rod 90 extending from the gas containing housing 88 and configured to be slidably received therein. Retraction of the gas spring rod 90 within the eras containing housing 88 can allow the pivot arm 70 to move between the extended and retracted positions.

It can be desirable to have a means to manually retract the outside scrub brush 56A and skirt 57A without needing to overcome the resistive force created by the gas spring 80. This can be desirable for several reasons. One reason is that with the outside scrub brush 56A and skirt 57A retracted, there can be improved access to the center scrub brush 56B, which can make servicing and replacing the center scrub brush 56B easier. Another reason that manually retracting the outside scrub brush 56A can be desirable is that when the sweeper-scrubber 30 is being used as a sweeper only (i.e. the scrub deck is not running), the outside scrub brush 56A protruding from the side of the machine can limit the ability to sweep next to curbs, walls, and other obstructions. Yet another reason that manually retracting the outside scrub brush 56A can be desirable is that when retracted, the overall footprint of the sweeper-scrubber 30 can be reduced, which can be beneficial during transport and storage.

In order to provide for manual retraction of the outside scrub brush 56A, the scrub deck retraction apparatus 65 can include a release mechanism, such as a rotating lever 92 as illustrated in FIG. 3. As described above, the first end 82 of the gas spring 80 can be rotatably coupled to the scrub deck frame 76 at the second pivot point 86. The second end 84 of the gas spring 80 can be rotatably coupled to the rotating lever 92 at a third pivot point 94, and cart be designed to go over-center as will be discussed in further detail below. The rotating lever 92 can include a first lever portion 96 extending in a first direction and a second lever portion 98 extending in a second direction. The second lever portion 98 can include a handle 100, such as an outwardly projecting flange, for ease of gripping by an operator. In the extended position of the pivot arm 70 as illustrated in FIG. 3, the rotating lever 92 can be configured to contact a stop 102 extending from the pivot arm 70.

The rotating lever 92 can be rotatably coupled to the pivot arm 70 at a fourth pivot point 104. Any suitable connection means can be used between the rotating lever 92 and the pivot arm 70 that allows for rotation of the lever 92. In an example, a threaded bolt 106 can be inserted through an aperture in the rotating lever 92 and engaged with a connection component 108 of the pivot arm 70 having a threaded receptacle. One or more washers 110 can be positioned between the threaded bolt 106 and the rotating lever 92 and/or the connection component 108 and the rotating lever 92. Other suitable connection means that cart allow for rotation of the lever 92 include, but are not limited to, snap-fit connections, press-fit connections, or the like.

To release the gas spring 80 so that the pivot arm 70 and outside scrub brush 56A are free to rotate about the first pivot point 74, the lever 92 can be pulled back past center so that the gas spring rod 90 is extended, thereby allowing the lever 92 to freely rotate while the pivot arm 70 is being manually retracted or extended. Because the handle 100 on the rotating lever 92 can be designed to have a significant mechanical advantage over the force of the gas spring 80, the rotating lever 92 can be engaged or released with relatively minimal force.

Figure 4:
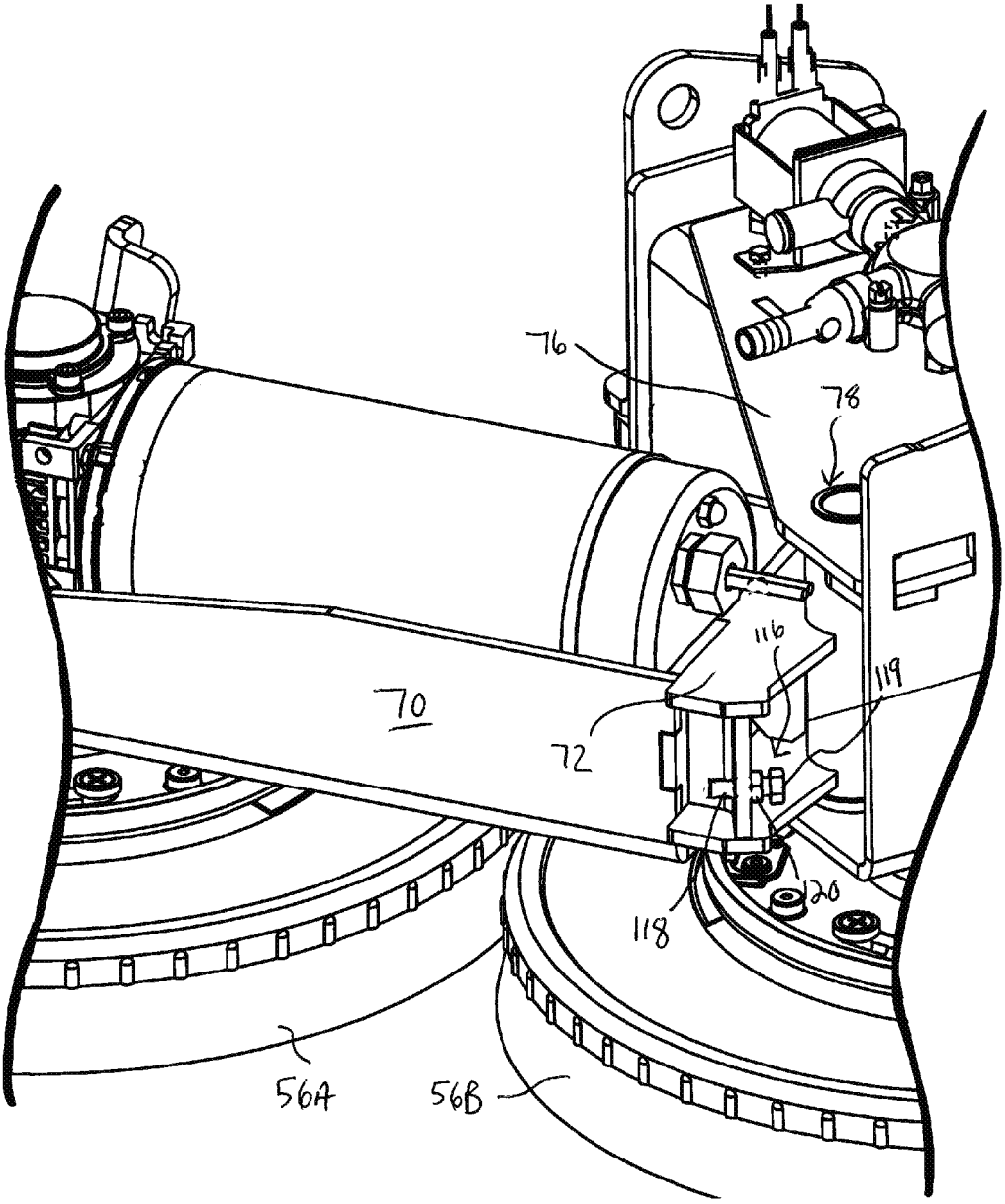
FIG. 4 is a view of an adjustable pivot arm feature of the scrub deck assembly.

The "fully" retracted position of the pivot arm 70 can be set by providing a contact surface 112 on the scrub deck frame 76. Thus, the pivot arm 70 can be configured to rotate inwardly until an outer pivot arm surface 114 at the first end 72 of the pivot arm 70 contacts the contact surface 112 on the scrub deck frame 76. The "fully" extended position of the pivot arm 70 can be adjustably set, as illustrated in FIG. 4. Particularly, the pivot arm 70 can include an adjustable stop member 116 that can be configured to prevent outward extension of the pivot arm 70 past a predefined point. Although any suitable means for providing art adjustable stop cart be used, in an example, the adjustable stop member 116 can include a threaded fastener member 118, such as a screw or a bolt, and a rotatable nut 120. The threaded fastener member 118 can be configured to mate with an internally threaded aperture in the pivot arm 70. Rotation of the threaded fastener member 118 can allow for extension or retraction of a head portion 119 of the fastener member, thereby adjusting the "fully" extended position of the pivot arm 70. Once the threaded fastener member 118 has been adjusted to the desired position, the rotatable nut 120 can be tightened against an outer surface of the pivot arm 70 to prevent or minimize movement of the threaded fastener member 118 as the head portion 119 contacts the scrub deck frame 76 during use. In various examples, the adjustable stop member 116 can be replaced with a fixed stop member.

Figure 5:
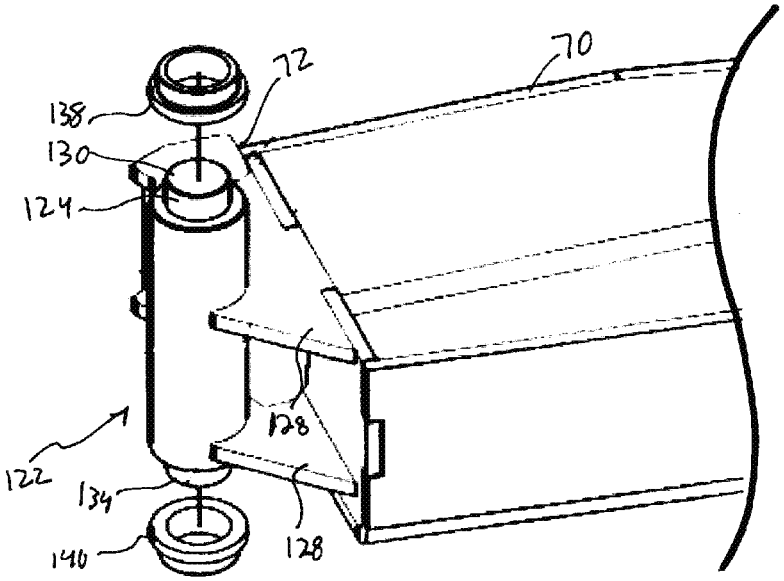
FIG. 5 is a perspective view of a first end of the pivot arm illustrating various connection components that can be used to rotatably couple the pivot arm to a scrub deck frame.

FIG. 5 is a perspective view of the first end 72 of the pivot arm 70 illustrating various connection components that can be used to rotatably couple the first end 72 at the first pivot point 78. Particularly, the first end 72 of the pivot arm 70 can include a frame connection means 122 including a substantially vertical shaft 124. The shaft 124 can be coupled to the first end 72 of the pivot arm 70 in any suitable manner, such as with one or more horizontally extending flanges 128 as illustrated in FIG. 5. A first end 130 of the shaft 124 can be configured to be received within a first aperture 132 (see FIG. 3) in the scrub deck frame 76 and a second end 134 of the shaft 124 can be configured to be received within a second aperture 136 (see FIG. 3) in the scrub deck frame 76. The portion of the scrub deck frame 76 including the first aperture 132 can be configured as a removable plate for ease of assembly. A first shaft bearing 138 can be positioned within the first aperture 132 in the scrub deck frame 76 to facilitate rotation of the shaft 124. Similarly, a second shaft bearing 140 can be positioned within the second aperture 136 in the scrub deck frame 76 to facilitate rotation of the shaft 124.

Figure 6:
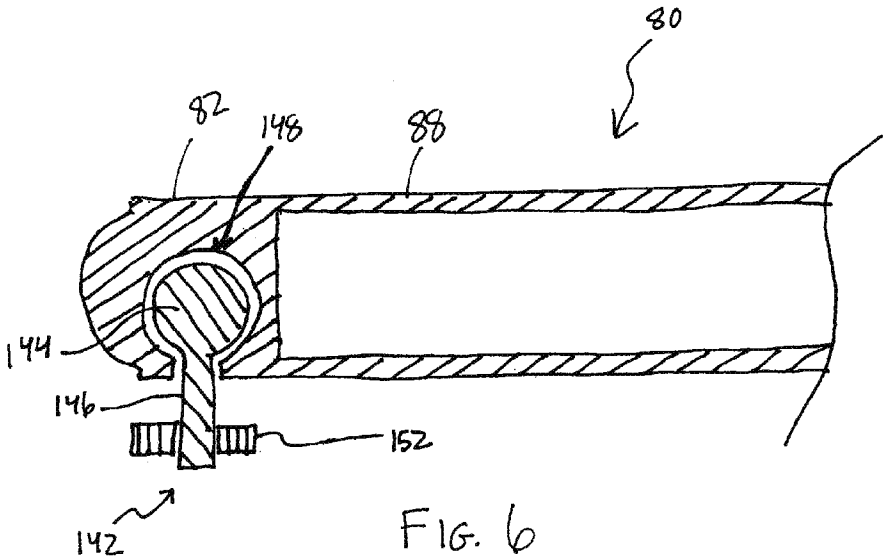
FIG. 6 is a cross-sectional view of a portion of a gas spring illustrating a gas spring connection component configured to rotatably couple the gas spring to the scrub deck frame.

FIG. 6 is a cross-sectional view of the first end 82 of the gas spring 80 illustrating a gas spring connection component 142 configured to rotatably couple the gas spring 80 to the scrub deck frame 76. As illustrated in FIG. 6, the gas spring connection component 142 can include a ball-shaped head 144 and an extension post 146 extending from the ball-shaped head 144. The ball-shaped head 144 and the extension post 146 can be formed as a single component or as separate components that are coupled together using a suitable connection means. The first end 82 of the gas spring 80 can include a corresponding ball-shaped receiving chamber 148 that can be sized larger than the ball-shaped head 144 to allow the ball-shaped head 144 to rotate therein. When assembled, the extension post 146 can be received within a post receiving aperture 150 (see FIG. 3) in the scrub deck frame 76. The extension post 146 can be retained within the post receiving aperture 150 using any suitable connection means, such as a threaded nut 152 that is configured to engage a threaded outer surface of the extension post 146.

With reference again to FIG. 3, the second end 84 of the gas spring 80 can also include a gas spring connection component 143 configured to rotatably couple the gas spring 80 to the rotating lever 92. The gas spring connection component 143 is shown in FIG. 3 disconnected from the rotating lever 92 merely for purposes of illustration. The gas spring connection component 143 can include similar components to the gas spring connection component 142, and can be coupled to the rotating lever 92 in a manner similar to the scrub deck frame 76.

Figure 7A:
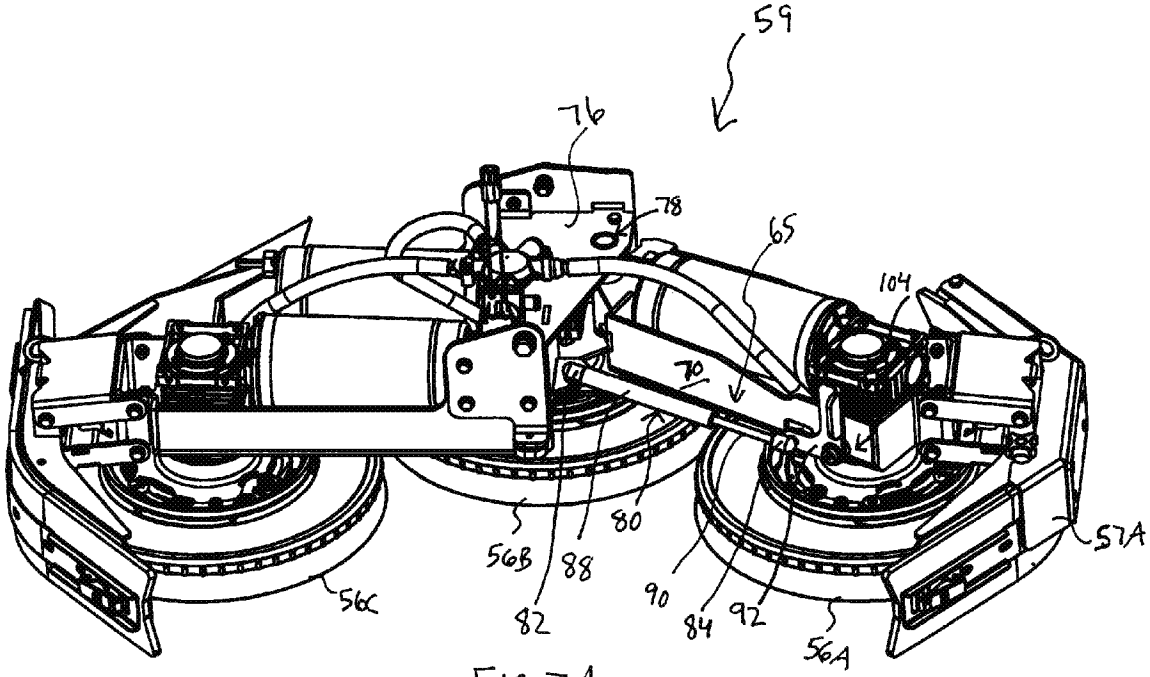
FIGS. 7A and 7B are perspective and partial side views, respectively, of the scrub deck assembly illustrating the pivot arm and an attached outside scrub brush 56A in a fully extended position and a release mechanism in an engaged position.
Figure 7B:
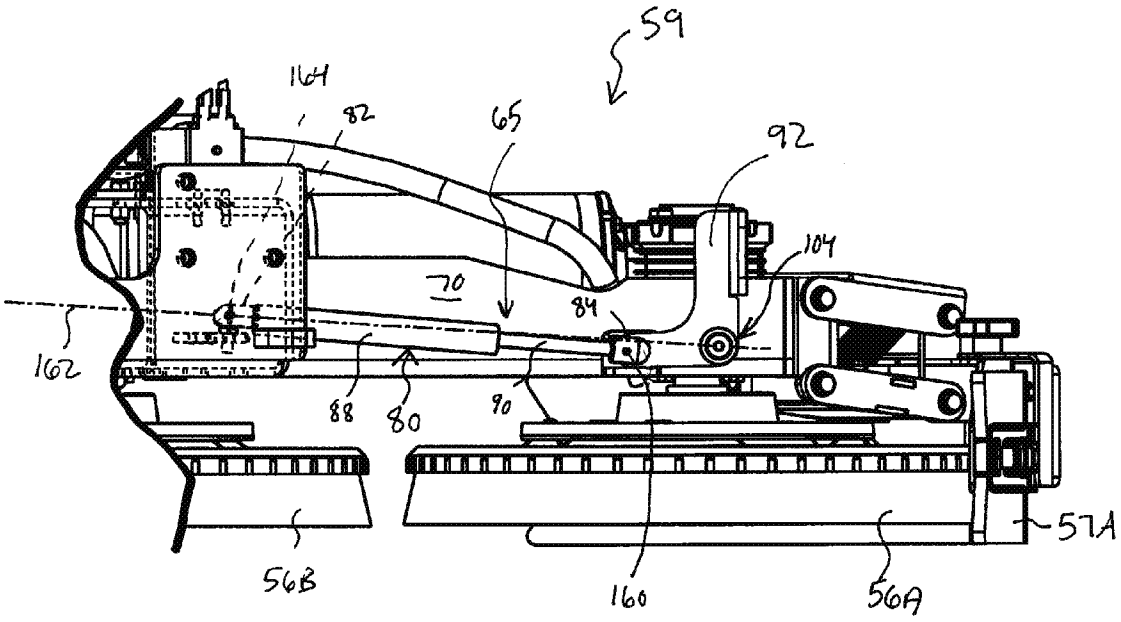

FIGS. 7A and 7B are perspective and partial side views, respectively, of the scrub deck assembly 59 illustrating the pivot a in 70 and the outside scrub brush 56A in the fully extended position and the rotating lever 92 in an engaged position. The position illustrated in FIGS. 7A and 7B is the normal "working" position of the scrub brush 56A during a scrubbing operation. With reference to FIG. 7B, in the engaged position of the rotating lever 92, a center point 160 of the ball-shaped head 144 of the gas spring connection component 143 can be positioned below an over-center line 162. The over-center line 162 can extend between a center point 164 of the ball-shaped head 144 of the gas spring connection component 142 and the fourth pivot point 104 at the coupling location of the rotating lever 92 and the pivot arm 70. Furthermore, in the engaged position of the rotating lever 92, a rigid connection can be formed between the rotating lever 92 and the gas spring 80 such that upon application of force to the outside scrub brush 56A and/or the associated skirt 57A, the gas spring rod 90 can slide within the gas containing housing 88, against the resistive force created by the gas spring 80, to allow rearward rotation of the pivot arm 70.

Figure 8A:
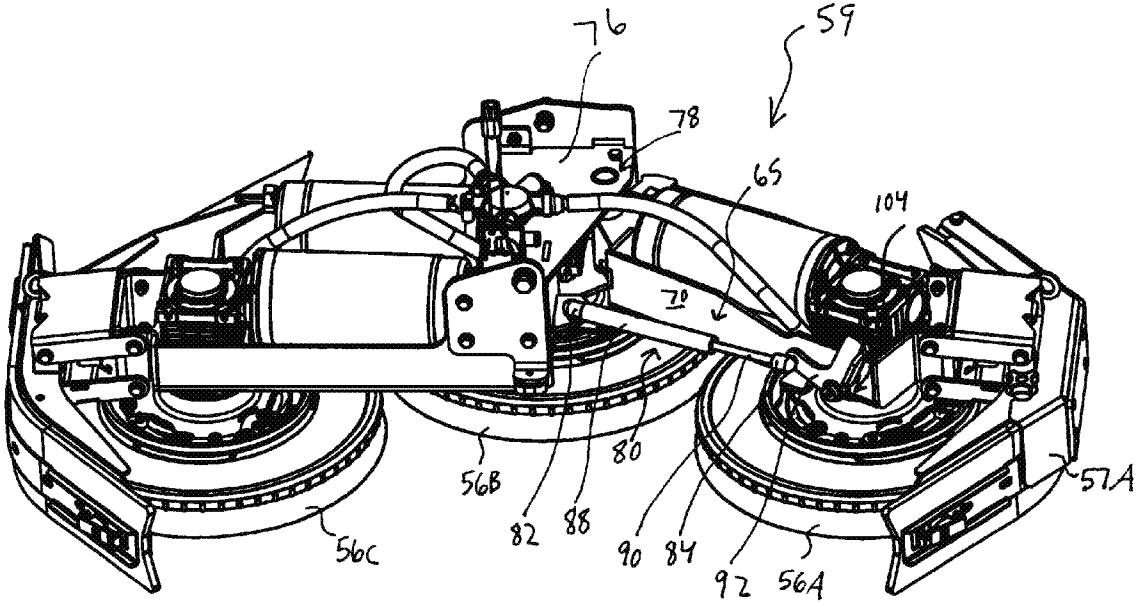
FIGS. 8A and 8B are perspective and partial side views, respectively, of the scrub deck assembly illustrating the pivot arm and outside scrub brush in the fully extended position and the release mechanism in a released position.
Figure 8B:
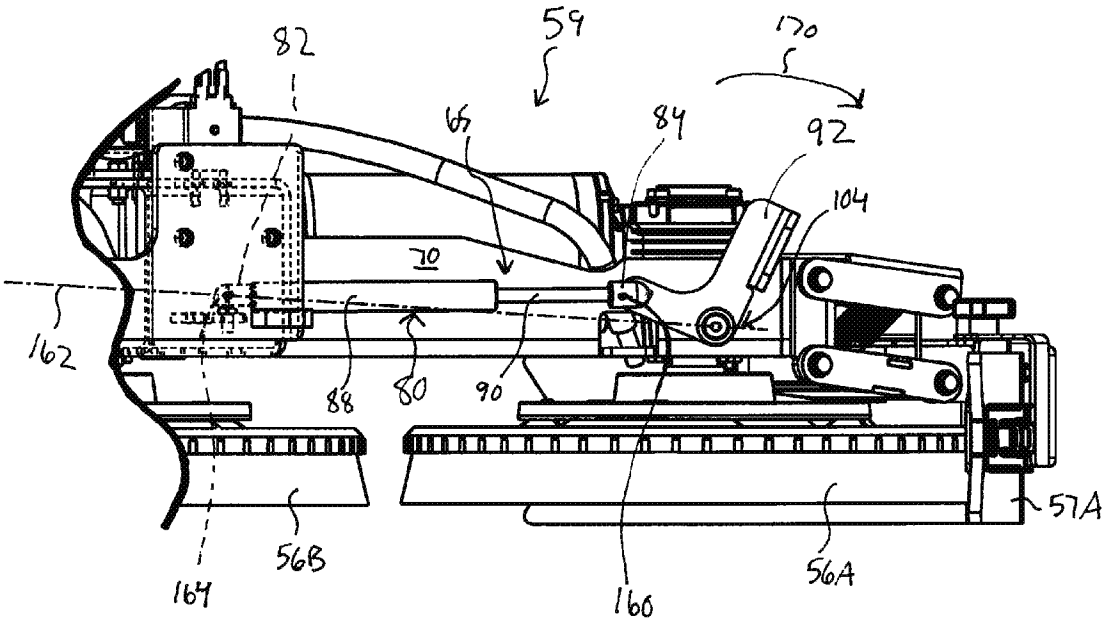

FIGS. 8A and 8B are perspective and partial side views, respectively, of the scrub deck assembly 59 illustrating the pivot arm 70 and the outside scrub brush 56A in the fully extended position and the rotating lever 92 in a released position. With reference to FIG. 8B, in order to move the rotating lever 92 to the released position, the lever 92 can be rotated in a clockwise direction 170 until the center point 160 passes above the over-center line 162. Rotating the lever 92 to the released position can extend the gas spring rod 90 from the gas containing housing 88 and "break" the rigid connection between the rotating lever 92 and the gas spring 80 and release the tension provided by the gas spring 80 on the pivot arm 70. In various examples, the amount of rotation required to move the rotating lever 92 from the engaged position to the released position can be minimal, such as on the order of 10-15 degrees or less. However, a greater amount of rotation can also be required. With the rotating lever 92 in the released position, the pivot arm 70 can be configured to freely rotate about the first pivot point 78 as will be further described below.

Figure 9A:
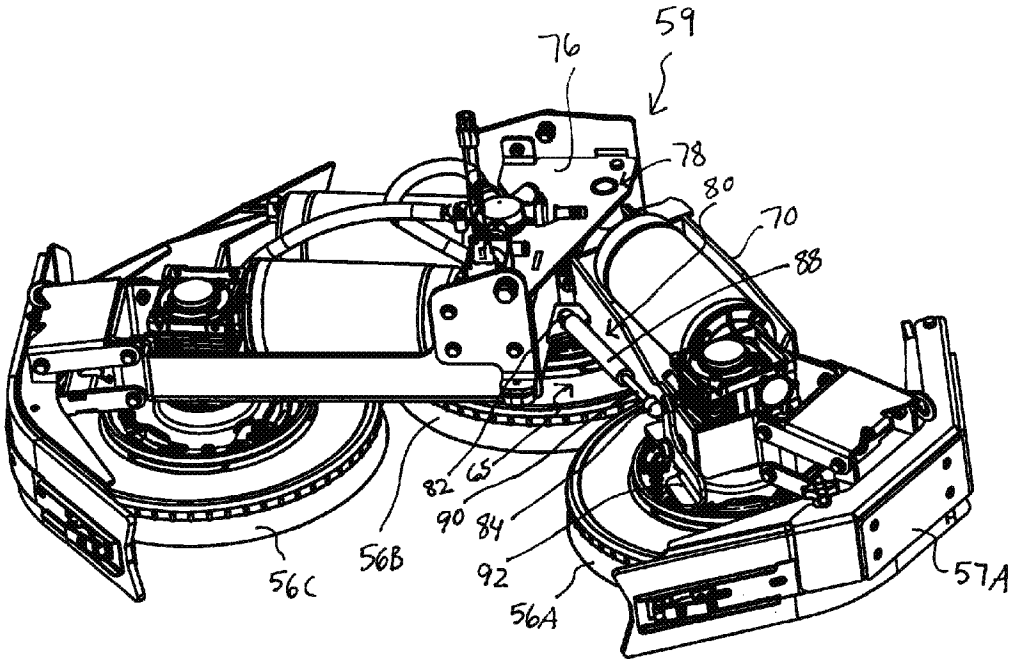
FIGS. 9A and 9B are perspective and partial side views, respectively, of the scrub deck assembly illustrating the release mechanism in the released position and the pivot arm and outside scrub brush in a fully retracted position.
Figure 9B:
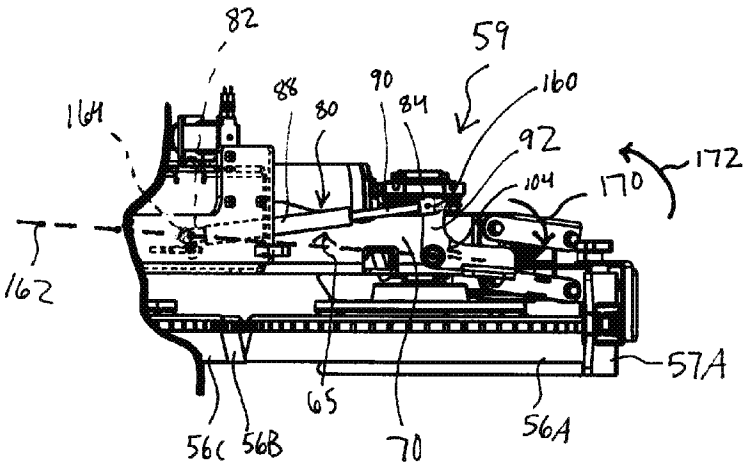

FIGS. 9A and 9B are perspective and partial side views, respectively, of the scrub deck assembly 59 illustrating the rotating lever 92 in the released position and the pivot arm 70 and the outside scrub brush 56A in the fully retracted position. Particularly, with the rotating lever 92 in the released position, the pivot arm 70 and the outside scrub brush 56A can be manually rotated in a rearward direction with minimal force due to the disengagement of the gas spring 80. As the pivot arm 70 and the outside scrub brush 56A are rotated in a rearward direction about the first pivot point 78, the lever 92 can continue to freely rotate in the clockwise direction 170 as a result of the extended length of the gas spring 80. When the pivot arm 70 and the outside scrub brush 56A are once again rotated from a retracted position to an extended position, the gas spring rod 90 can pull the lever 92 such that it rotates in a counter-clockwise direction as indicated by arrow 172.

With the pivot arm 70 and the outside scrub brush 56A manually rotated to a retracted position, an operator can more easily access the center scrub brush 56B, such as for repair or replacement. Additionally, the overall footprint of the sweeper-scrubber 30 can be decreased for storage or transport. Furthermore, the outside scrub brush 56A can be fully operational in a retracted position, allowing a scrubbing operation to be performed even when the outside scrub 56A is not in the fully extended position.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A method operating a scrub deck retraction apparatus comprising:

providing or obtaining a scrub deck assembly including:

a first rotatable brush operably coupled to a scrub deck frame;

a second rotatable brush operably coupled to a pivot arm, the pivot arm rotatably coupled to the scrub deck frame at a pivot point; and a scrub deck retraction apparatus including a gas spring extending between the scrub deck frame and the pivot arm and a release mechanism coupled to the gas spring, the release mechanism also rotatably coupled to the pivot arm creating an over-center cam mechanism, the gas spring including a gas containing housing and a gas spring rod;

rotating the release mechanism from an engaged position to a released position, thereby extending the gas spring rod from the gas containing housing, wherein rotating the release mechanism comprises rotating an end of the gas spring rod above an over-center line; and retracting the second rotatable brush relative to the first rotatable brush by rotating the pivot arm about the pivot point.

2. The method of claim 1, wherein the release mechanism is rotatably coupled to the gas spring.

3. A scrub deck assembly comprising:

a scrub deck frame;

a pivot arm having a first end and a second end, the pivot arm rotatably coupled to the scrub deck frame at the first end;

a scrub brush operably coupled adjacent to the second end of the pivot arm;

a retraction mechanism configured to allow movement of the pivot arm, relative to the scrub deck frame, about the first end; and a release mechanism operably coupled to the retraction mechanism, the release mechanism configured to disengage operation of the retraction mechanism, wherein the release mechanism is coupled to the pivot arm creating an over-center cam mechanism.

4. The scrub deck assembly of claim 3, wherein the first end of the pivot arm includes a substantially vertical shaft that is configured to be received within one or more apertures in the scrub deck frame.

5. The scrub deck assembly of claim 4, further comprising one or more shaft bearings configured to be positioned within the one or more apertures in the scrub deck frame.

6. The scrub deck assembly of claim 3, wherein the retraction mechanism is a gas spring.

7. The scrub deck assembly of claim 6, wherein the release mechanism is a lever.

8. The scrub deck assembly of claim 7, wherein the gas spring is rotatably coupled to the scrub deck frame and the lever.

9. The scrub deck assembly of claim 6, wherein the gas spring includes a gas containing housing and a gas spring rod extending from the gas containing housing, the gas spring rod configured to be slidably received within the gas containing housing.

10. The scrub deck assembly of claim 9, wherein the release mechanism is a lever, the lever being rotatably coupled to the pivot arm at a first location and to the gas spring rod at a second location.

11. The scrub deck assembly of claim 10, wherein rotation of the lever from an engaged position to a released position extends the gas spring rod from the gas containing housing, thereby allowing the pivot arm to freely rotate about the first end relative to the scrub deck frame.

12. A scrub deck assembly comprising:

a scrub deck frame;

a first rotatable brush operably coupled to the scrub deck frame;

a pivot arm having a first end and a second end, the first end coupled to the scrub deck frame;

a second rotatable brush operably coupled to the second end of the pivot arm; and a scrub deck retraction apparatus including:

a gas spring having a first end rotatably coupled to the scrub deck frame; and a release mechanism coupled to the pivot arm and creating an over-center cam mechanism, the release mechanism further coupled to a second end of the gas spring;

wherein the gas spring allows rotation of the pivot arm relative to the scrub deck frame, from an extended position to a retracted position, upon application of a force to the gas spring.

13. The scrub deck assembly of claim 12, wherein the release mechanism is a lever.

14. The scrub deck assembly of claim 12, further comprising a third scrub brush operably coupled to the scrub deck frame.

15. The scrub deck assembly of claim 12, further comprising a skirt member coupled to the second end of the pivot arm adjacent to the second rotatable brush.

16. The scrub deck assembly of claim 12, wherein the gas spring includes a gas containing housing at the first end and a gas spring rod at the second end, the gas spring rod configured to be slidably received within the gas containing housing.

17. The scrub deck assembly of claim 16, wherein the release mechanism is a lever, the lever being rotatably coupled to the pivot arm at a first location and to the gas spring rod at a second location.

18. The scrub deck assembly of claim 17, wherein rotation of the lever from an engaged position to a released position extends the gas spring rod from the gas containing housing, thereby allowing the pivot arm to freely rotate relative to the scrub deck frame.

19. The scrub deck assembly of claim 18, wherein the lever is configured to contact a stop member extending from the pivot arm in the engaged position.

* * * * *